United States Patent [19]

Jacobson

[11] Patent Number: 4,792,253

[45] Date of Patent: Dec. 20, 1988

[54] BINDER RING HAVING SLIP-ON FOLIO STOPS

[76] Inventor: Ralph S. Jacobson, 131-1909 Salton Road, Abbotsford, British Columbia, Canada

[21] Appl. No.: 91,332

[22] Filed: Aug. 31, 1987

Related U.S. Application Data

[63] Continuation-in-part of Ser. No. 923,580, Oct. 27, 1986, abandoned.

[51] Int. Cl.[4] ..... B42F 13/16; B42F 13/26; A44B 15/00; A47G 29/10

[52] U.S. Cl. ..... 402/20; 402/72; 70/456 R; 70/459

[58] Field of Search ..... 402/13, 14, 18, 19, 402/20, 31, 70, 72; 63/3; 70/454, 453, 456 R, 456 B, 459, 460, 461; 40/625

[56] References Cited

U.S. PATENT DOCUMENTS

| | | | |
|---|---|---|---|
| 806,230 | 3/1907 | Morden | 402/72 |
| 876,474 | 1/1908 | Morden | 402/20 |
| 1,283,901 | 11/1918 | Rettig | 402/20 |
| 1,331,226 | 2/1920 | Adams | 402/20 |
| 1,473,354 | 11/1923 | Nachtries | 402/20 |
| 1,817,246 | 8/1931 | Gardine | 70/458 |
| 2,099,881 | 11/1937 | Emmer | 402/20 |
| 2,551,384 | 5/1951 | Middleton et al. | 70/458 |
| 3,618,346 | 11/1971 | Humphrey | 70/456 R |
| 4,091,646 | 5/1978 | Sugimoto | 70/456 R |
| 4,516,776 | 5/1985 | Nicholas | 70/459 |

FOREIGN PATENT DOCUMENTS

| | | | |
|---|---|---|---|
| 5602 | 12/1910 | United Kingdom | 402/20 |

*Primary Examiner*—E. R. Kazenske
*Assistant Examiner*—Paul M. Heyrana, Sr.
*Attorney, Agent, or Firm*—Norman E. Reitz

[57] ABSTRACT

A binder ring has folio stops affixed to the end of at least one binder ring section. When the binder ring is in the open position the folio stop impedes a folio sheet from inadvertently sliding off the ring section. The folio stop slips on when the binder ring is opened and slips off when the binder ring is closed to be unobtrusive.

3 Claims, 3 Drawing Sheets

FIG. 1
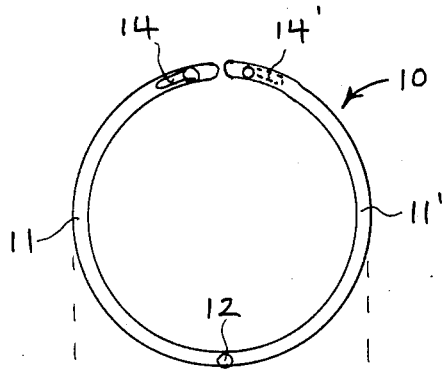
FIG. 1A
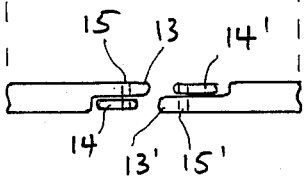
FIG. 2
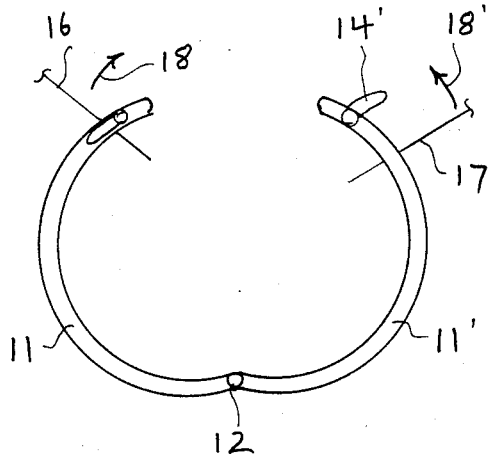
FIG. 3
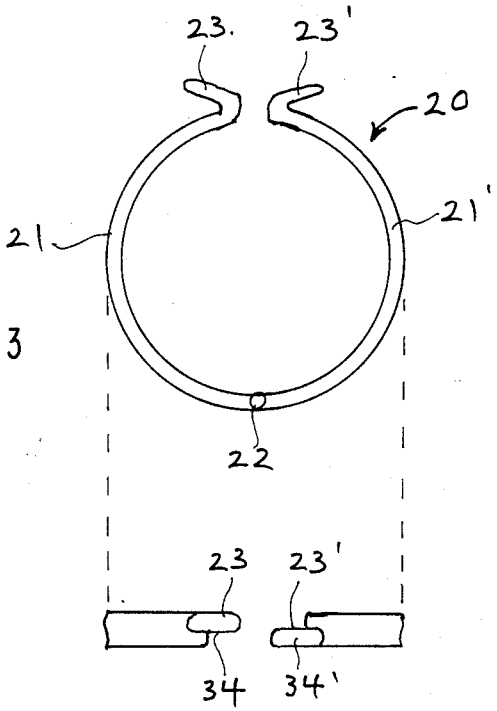
FIG. 4
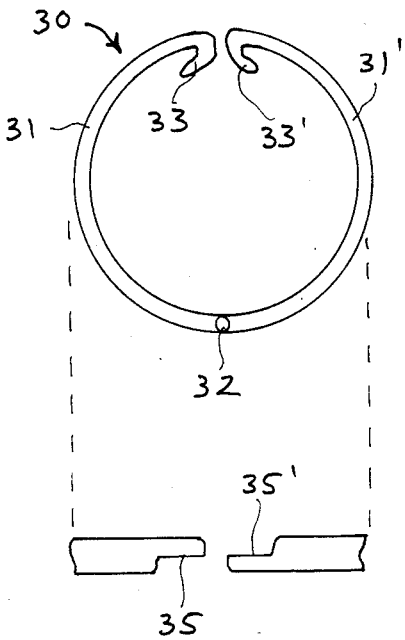
FIG. 3A
FIG. 4A

BINDER RING HAVING SLIP-ON FOLIO STOPS

This is a continuation-in-part of co-pending application Ser. No. 923,580 filed on Oct. 27, 1986, now abandoned.

This invention relates to a binder ring which holds individual folio sheets and, more particularly, relates to a binder ring having adjustable folio stops which prevent individual folio sheets from sliding off the ring while the ring is opened.

Loose leaf binders have long been used to hold individual folio sheets. Typically, the individual folio sheets have holes punched in them and the sheets are held in place by spindle-like structures which pass through the holes. For maximum utility the spindle-like structures are usually provided with a means whereby individual folio sheets can be removed or inserted as desired.

In a common prior art device the spindle-like structures which pass through the holes in the folio sheets are semi-circular steel strips which are hinged together at one end and which are detachably attachable at the other end. For example see N. D. Nachtrieb, "Temporary Binder Ring", U.S. Pat. No. 1,473,354 and G. L. Crosby, "Loose Leaf Binder", U.S. Pat. No. 1,807,390. Variations on this prior art binder ring structure include J. C. Montague, "Temporary Binder", U.S. Pat. No. 722,870 (matable hollow binder ring sections); V. E. Cardinelli, "Loose Leaf Binder", U.S. Pat. No. 4,349,289 (the tab 5 fits into the hole 6 to close the half loops 4); and J. C. Dawson et al., "Loose Leaf Binder", U.S. Pat. No. 866,845 (ring halves have a heel which presses firmly against the binder back 12 for stability).

When individual folio sheets are inserted into loose leaf binders or removed therefrom it sometimes occurs that a sheaf of the folio sheets will inadvertently slip off the ring or rings. The order of the sheets may then be changed thereby requiring reordering. At a minimum the sheaf of sheets must be arranged in proper registration and placed back on the rings. This problem is annoying and time consuming. One prior art patent to C. D. Trussel, "Loose Leaf Binder", U.S. Pat. No. 1,454,869, discloses a mechanism for keeping the folio sheets in a neat stack while they are on the ring but does not show means for preventing the sheets from slipping off the ring when the ring is opened. It would be useful to have a mechanism which prevents individual folio sheets from inadvertently slipping off a binder ring when it is opened.

It is therefore an object of the present invention to provide a binder ring having an adjustable folio stop at one end.

It is another object of the present invention to provide a binder ring which functions in a conventional manner when closed but prevents folio sheets from inadvertently slipping off when the ring is opened.

BRIEF DESCRIPTION OF THE DRAWINGS

For a more complete understanding of the binder ring of the present invention reference may be had to the accompanying drawing which is incorporated herein by reference and in which:

FIG. 1 is a side view of the preferred embodiment of the ring section of the present invention having adjustable folio stops;

FIG. 1A is a plan view of the ring section of FIG. 1;

FIG. 2 is a side view of the preferred embodiment with one folio stop in an extended position;

FIG. 3 is a side view of an embodiment of the present invention in which the folio stops are configured in a fixed outward position;

FIG. 3A is a plan view of FIG. 3;

FIG. 4 is a side view of an embodiment of the present invention in which the folio stops are configured in a fixed inward position;

FIG. 4A is a plan view of FIG. 4.

FIG. 8*a* is a detailed edge view of the depression formed in the binder ring taken from the perspective view of line 8*a*—8*a.

SUMMARY OF THE INVENTION

Figure 5:
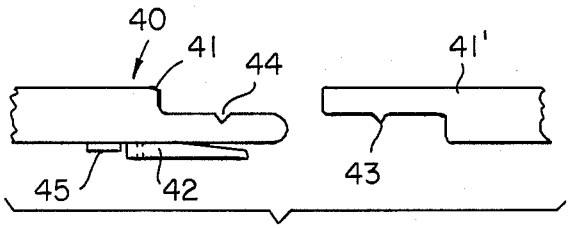
FIG. 5 is a plan view of yet another embodiment of the present invention.

A conventional binder ring comprising a pair o hinged, semi-circular ring halves is provided with an adjustable folio stop at the end of at least one of the ring halves. The folio stop is adjustable between a stored position at which it does not impede the movement of the folio sheets on the binder ring and a stop position at which it prevents folio sheets from inadvertently sliding off the ring. When the ring halves are snapped together the folio stop rests in the stored position; when the ring halves are opened, at the discretion of the user the folio stop may be placed in the stop position.

DESCRIPTION OF THE PREFERRED EMBODIMENTS

An improved binder ring is provided that stops folio sheets from inadvertently sliding off when particular sheets are being inserted or removed. This is accomplished by affixing folio stops to the end of at least one of the binder ring halves. Preferably, the stops are adjustable so they are unobtrusive while the ring valves are closed together, yet protrude sufficiently to stop sheets from sliding off when the ring halves are opened.

As seen in FIG. 1 in the preferred embodiment the binder ring 10 of the present invention comprises a pair of semicircular ring sections 11, 11' which are hinged together at hinge 12. In operation, the ring sections 11, 11' may close together to form a circular binder ring on which a plurality of folio sheets may be held. When additional sheets are to. be inserted or when sheets are to selectively be removed the ring sections 11, 11' are swung apart as shown in FIG. 2. With a conventional binder ring a folio sheet 16 may slip readily off the ring section. This movement is desirable when intentional, an annoyance when unintentional. With the improved binder ring of the present invention when it is not desired to have folio sheets on a given ring section slip off, even though the ring sections are swung apart, an adjustable folio stop 14' is swung outward (FIG. 2) to impede the movement of the sheet 17 (indicated by arrow 18'). At the same time a sheet 16 may be removed from ring section 11 (indicated by arrow 18') since folio stop 14 has not been deployed in the stop position. Thus, sheets may be inserted onto ring section 11 or removed therefrom but are securely held on ring section 11'.

The structure of the folio stops is of several configurations. In FIGS. 1–2, the folio stops 14, 14' are adjustable; in FIGS. 3–4 the folio stops 23, 23' and 33,33' are a permanent extension of the ring sections 21, 21' and 31,31', respectively. The adjustable configuration of FIGS. 1–2 is preferred since the folio stops 14, 14' may be stored in an unobtrusive position, shown in FIGS. 1 and 1A, when the binder ring is closed. Yet, when needed, the folio stops 14, 14' can be easily swivelled on stems 15, 15' to a stop position, shown in FIG. 2 for stop 14'. As seen particularly in FIG. 1A the folio stops 14, 14' are rotatably attached to the rig sections 11, 11' a set distance from the ends thereof to allow the matable tips 13, 13,13' to snap together as the binder ring is closed. The range of movement of the folio stops i4, i4' is preferrably from the stowed position shown in FIG. 1A to the open position shown. In FIG. 2 for stop 14'. To prevent the stops 14, 14' from swiveling 180° to be in-line with the curvature of the binder ring, i.e. to prevent the folio stops from passing though the 90° position shown for stop 14' in FIG. 2, a protrusion may be provided, as shown, for example, by the protrusion 43 FIGS. 5 and 6 on the side of the binder ring to provide a positive stop for the folio stop. Alternately, the stems 15, 15' of the folio stops may have a limited range of movement, i.e. from the stowed position of FIG. 1A to the 90° position of folio stop 14'. In FIG. 2.

A fixed folio stop configuration is shown in FIGS. 3 and 4. In FIGS. 3 and 3A semi-circular ring sections 21 and 21' and shown to be hinged about hinge 22. Folio stops 23, 23' are continuous extensions of the ends of the ring sections 21, 21', respectively, and are shaped to extend outwardly of the ring sections. When the binder ring 20 is closed the matable indentations 34, 34' snap together. The size of the fixed folio stops 23, 23' is small enough to permit folio sheets to slide over them but large enough to impede the movement when the ring sections are moved apart. In FIGS. 4. and 4A he ring sections 31, 31' of binder ring 30 are shown to be hinged about hinge 32. The folio stops are shaped to extend inwardly of the ring sections. When the binder ring 30 is closed the matable indentations 35, 35' snap together. Preferably, the holes on folio sheets will pass over the folio stops 33, 33' when the binder ring 30 is closed but the sheets will be impeded from sliding off the ring sections 31, 31' when the ring sections 31, 31' are swung apart.

Figure 6:
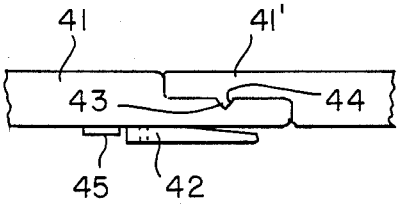
FIG. 6 is a plan view of t he embodiment of FIG. 5 with the ends snugly mated together.
Figure 5A:
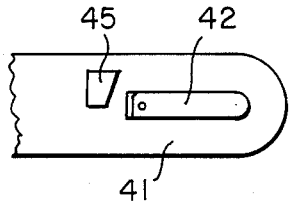
FIG. 5A is a detailed side view of one of the ring sections of FIG. 5.

A means of matably connecting the ends 41 and 41, of facing ring sections is shown in FIGS. 5 and 6. Here the protruding tit 43, affixed to the inside of the end 41', slips into the circular depression 44, formed in the inside of the end 41. When the ends 41, 41' are fitted together they will not slip apart in normal usage. The protrusion 45 establishes the end of travel for the folio stop 42.

Figure 7:
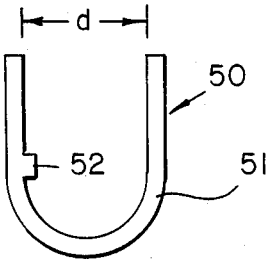
FIG. 7 is a side view of a detachable folio stop.
Figure 8:
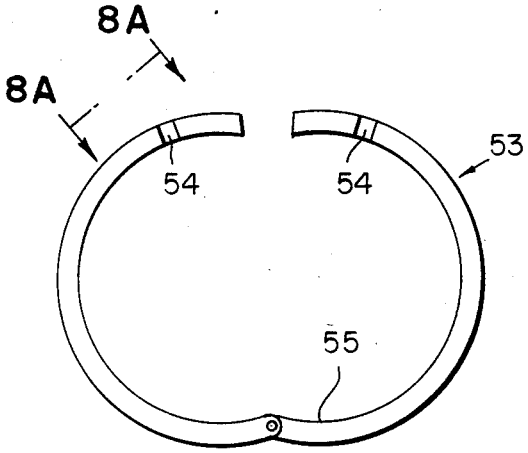
FIG. 8 is a side view of a binder ring having depressions formed therein adjacent either end for receiving the detachable folio stop of FIG. 7.
Figure 8A:
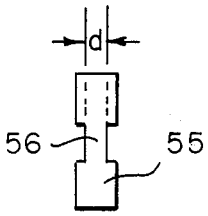
Figure 9:
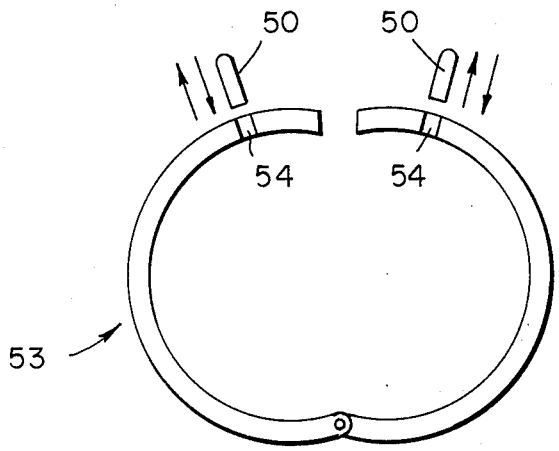
* and FIG. 9 is a side view of the binder ring of FIG. 8 illustrating the manner and direction of attachment and detachment of the detachable folio stop of FIG. 7.

An alternate embodiment in which the folio stops 50 are detachably attachable to the binder ring 53 is shown in FIGS. 7–9. Here the detachable folio stop 50 comprises a U-shaped member 51 having an inwardly facing protrusion 52. The interior spacing d of the folio stop 50 is sized to fit in a press fit over the depressions 54 formed adjacent the ends of the binder ring 53. As shown particularly in FIGS. **8*a* and 9 folio stops 50 are slide over the neck region 56 of the binder rings 53 associated with the depressions 54; they may be removed in the same manner. The folio stops 50 will slide down until the protrusion 52 rests on the neck 56. Since the body of the stop 50 fits partially within the depressions 54** it will not rotate as folio sheets come to rest against it. When the folio stops are not in use they are removed and stored.

I claim:

1. An improved binder ring which impedes folio sheets from sliding off the ends of the ring sections, said binder ring having a pair of semi-circular ring sections with hinge means attached to one end of each of said ring sections whereby said ring sections are connected together and may rotate between an open position at which the other ends of said ring sections are spaced apart and a closed position at which said other ends are fitted together in press fit contact so that said sections form a closed, substantially circular binder ring, the improvement comprising:

folio stops which are detachably attachable, respectively, to said other ends of said ring sections whereby when said folio stops are detachably attached to said other ends of said ring sections, folio sheets being held on said ring sections are impeded from sliding off said other ends of said ring sections.

2. An improved binder ring in accordance with claim 1 wherein depressions are formed in said binder ring adjacent the ends to accommodate said detachably attachable folio stops in a press fit.

3. An improved binder ring in accordance with claim 2 wherein said detachably attachable folio stops have an inwardly facing protrusion to serve as a stop for the placement of said folio stops within said depression.

* * * * *